United States Patent [19]

Sapkus et al.

[11] 3,994,092

[45] Nov. 30, 1976

[54] FIGURE TOY HAVING REVERSE GEAR RATIO BETWEEN LIMBS

[75] Inventors: Jurgis Sapkus, Manhattan Beach; J. Stephen Lewis, Pacific Palisades, both of Calif.

[73] Assignee: Mattel, Inc., Hawthorne, Calif.

[22] Filed: Dec. 5, 1975

[21] Appl. No.: 637,905

[52] U.S. Cl. ..... 46/119; 46/121; 46/128; 46/136

[51] Int. Cl.[2] ..... A63H 3/20

[58] Field of Search ..... 46/119, 120, 121, 126, 46/128, 136, 139, 161, 163

[56] References Cited

UNITED STATES PATENTS

| | | | |
|---|---|---|---|
| 525,716 | 9/1894 | McElroy | 46/119 |
| 3,147,566 | 9/1964 | Ong | 46/149 |
| 3,594,942 | 7/1971 | Hollingsworth et al. | 46/120 |
| 3,616,570 | 10/1971 | Groves et al. | 46/120 |
| 3,641,702 | 2/1972 | Gardel et al. | 46/120 |
| 3,852,911 | 12/1974 | Sapkus et al. | 46/126 |

*Primary Examiner*—G.E. McNeill
*Assistant Examiner*—Robert F. Cutting
*Attorney, Agent, or Firm*—Max E. Shirk; Stephen L. King; John M. May

[57] ABSTRACT

Driving gear on one limb has at least twice as many teeth as driven gear on other limb which is connected to driving gear by idler gears for negatively increasing gear ratio between limbs so that driven limb will swing through a substantially larger arc than, and in a direction opposite to, the driving limb.

5 Claims, 8 Drawing Figures

74
32
86
84
88
54
30
80
80
82
82
84
34
10
54
54
50
52
36
48
54
28
42
26
46
44
40
58
38
118
116
6
7
128
124
126
122
114
62
72
104
172
154
106
158
72
160
108
136
154
146
120
172
102
140
152
158
60
146
152
172
64
150
7
6
144
90
58
66
148
148
134
130
138
150
144
100
110
56
68
132
70

FIGURE TOY HAVING REVERSE GEAR RATIO BETWEEN LIMBS

BACKGROUND OF THE INVENTION

The background of the invention will be set forth in two parts.

1. Field of the Invention

The present invention relates generally to the field of animated figure toys and more particularly to a figure toy having a reverse gear ratio between limbs so that a driven limb will swing to a substantially larger arc than, and in a direction opposite to, a driving limb.

2. Description of the Prior Art

The prior art known to applicant is listed by way of illustration, but not of limitation, in separate communications to the U.S. Patent Office.

The present invention exemplifies improvements over this prior art.

SUMMARY OF THE INVENTION

A primary object of the invention is to provide a new and useful figure toy having limbs connected together by gears providing a reverse gear ratio between limbs so that a driven limb will swing through a substantially larger arc than, and in a direct opposite to, a driving limb.

According to the present invention, a figure toy which is shown herein for purposes of illustration, but not of limitation, as comprising a ballerina doll, includes a pair of legs connected together by a gear train which negatively increases the gear ratio between the legs so that one leg will be swung through a substantially larger arc than, and in a direction opposite to, the other leg. With this arrangement, the doll may be tilted slightly with one leg on the floor and the other leg will swing upwardly high and fast.

The gear ratio is shown herein for purposes of illustration, but not of limitation, as having a 4.2:1 negative gear ratio. This may be accomplished by affixing a 23-toothed driving gear to one leg and a seven-toothed driven gear to the other leg. The gears may then be connected together by a pair of idler gears affixed to a shaft. One idler gear may be provided with seven teeth and drivingly engages the driving gear. The other idler gear may be provided with nine teeth and drivingly engages the driven gear.

The driving gear may comprise a ring gear formed integrally with a first hub affixing the ring gear to a driving leg on the doll. The driven gear may comprise a spur gear affixed to a shaft having a first end carrying a second hub affixed to the driven leg of the doll. The shaft which carries the driven gear includes a free end which is rotatably mounted in the first hub.

The features of the present invention which are believed to be novel are set forth with particularity in the appended claims. The present invention, both as to its organization and manner of operation, together with further objects and advantages thereof, may best be understood by reference to the following description taken in connection with the accompanying drawings in which like reference numerals refer to like elements in the several views.

DESCRIPTION OF THE PREFERRED EMBODIMENT

Figure 1:
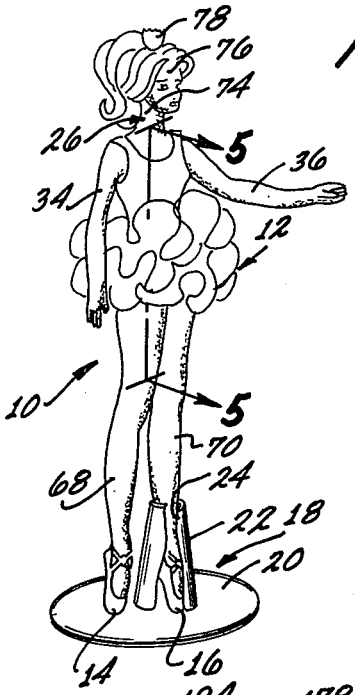
FIG. 1–4 are perspective views showing a doll constituting a presently-preferred embodiment of the invention in different positions.
Figure 5:
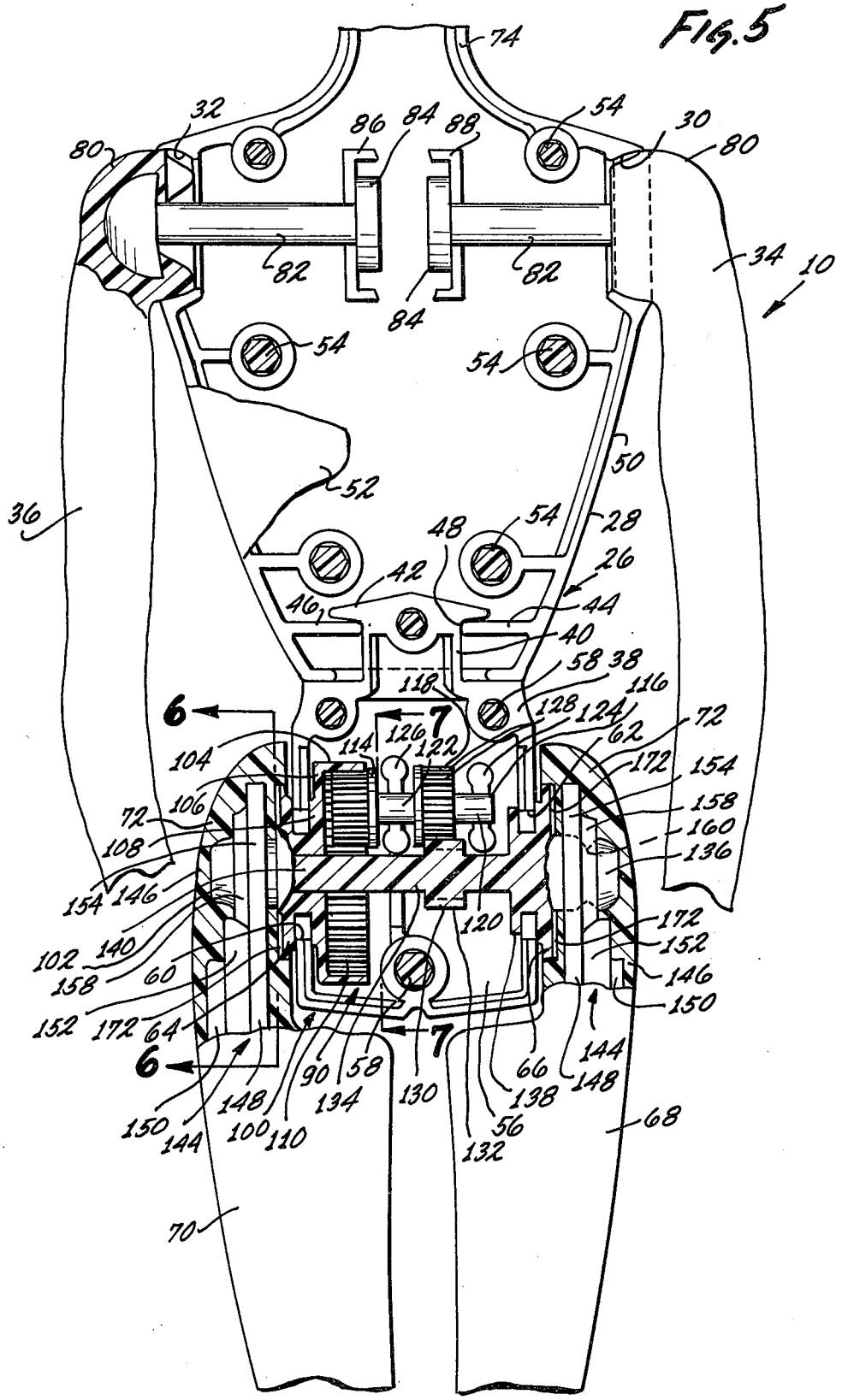
FIG. 5 is an enlarged, partial cross-sectional view taken along line 5—5 of FIG. 1.

Referring again to the drawings, and more particularly to FIGS. 1 and 5, a figure toy constituting a presently preferred embodiment of the invention, generally designated 10, is shown herein for purposes of illustration, but not of limitation, as comprising a ballerina doll attired in a tu-tu 12 and a pair of toe-slippers 14, 16. Figure toy 10 may be supported by a suitable posing stand 18 (FIG. 1) having a base member 20 and an upstanding hollow post 22 provided with an elongated opening 24 adapted to receive one limb of figure toy 10.

Figure toy 10 includes a torso 26 including an upper torso member 28 having a pair of shoulder openings 30, 32 rotatably receiving a right arm 34 and a left arm 36 constituting a pair of limbs for figure toy 10. Torso 26 also includes a lower torso member 38 rotatably connected to upper torso member 28 by an upstanding post 40 having an enlarged head 42 engaging the upper surface 44 of a partition 46 having an opening 48 provided therein for receiving post 40. The upper torso member 28 includes a front, upper torso half 50 and a rear, upper torso half 52 which may be connected together by suitable pin-and-socket combinations 54. The lower torso member 38 may also include a front, lower torso half 56 and a rear, lower torso half (not shown) connected together by suitable pin-and-socket combinations 58.

As best seen in FIG. 5, the lower torso portion 38 is provided with a pair of hip openings 60, 62 in which left and right hip mounting members 64, 66 respectively, are rotatably mounted. Figure toy 10 also includes a pair of limbs or legs 68, 70 each having an upper end 72 affixed to an associated one of the hip mounting members 64, 66.

The upper torso member 28 is provided with a neck portion 74 on which a doll head 76 is mounted. A suitable hand grip 78 may be affixed to head 76 for use in manipulating figure toy 10, if desired.

The arms 34, 36 each include an upper end 80 affixed to a rubber connector 82 having an end 84 trapped by an associated one of the brackets 86, 88 mounted in upper torso member 28.

Referring now to FIGS. 5–8, figure toy 10 also includes a gear train 90 which may be made from a suitable polymeric material and which includes a driving gear 100 formed integrally with the mounting member 64 and a hollow hub 102. Driving gear 100 includes a ring gear 104 carried by a plate 106 having an outer surface 108 journaled in hip opening 60 adjacent hip mounting member 64. Ring gear 104 is provided with a plurality of teeth 110 drivingly engaging the teeth 112 provided on a first idler gear 114 formed integrally with a shaft 116 and a second idler gear 118. Shaft 116 includes a free end 120 and an intermediate portion 122 journaled in brackets 124, 126, respectively, mounted in lower torso member 38. The second idler gear 118 includes a plurality of teeth 128 drivingly engaging the teeth 130 on a driven gear 132 carried by a shaft 134 having a first end formed integrally with hip mounting member 66, a hub 136 and a bearing flange 138. Flange 138 is journaled in hip opening 62 adjacent hip mounting member 66. Shaft 134 includes a free end 140 rotatably mounted in hub 102, hip mounting member 64 and plate 106.

Figure 2:
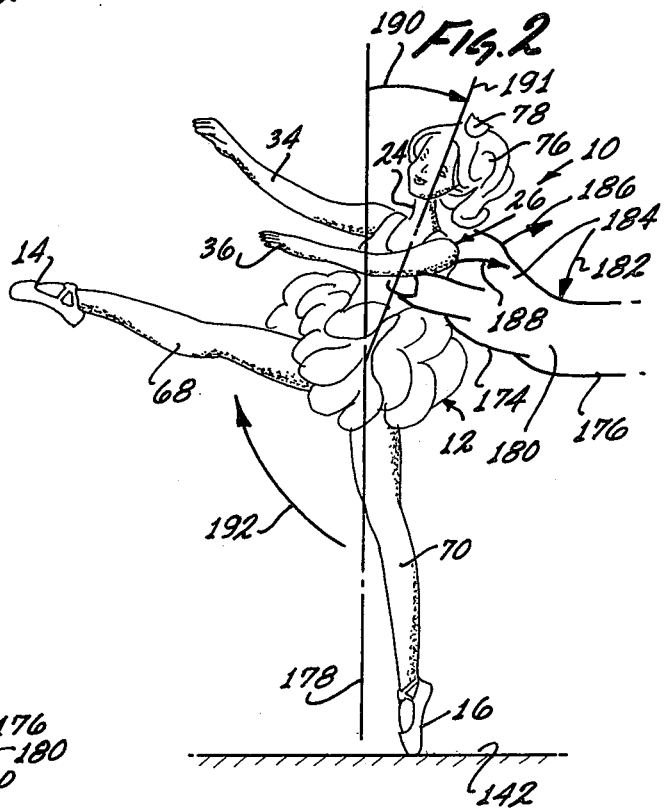

Gear train 90 is provided with a negative or reverse ratio so that driving gear 100 will drive driven gear 132 through idler gears 114, 118 at a rate such that a slight rearward movement on torso 26 when leg 70 is held stationary on a supporting surface 142 (FIG. 2) will cause right leg 68 to kick upwardly high and fast. A number of different gear ratios will manifest themselves to those skilled in the art. For example, a gear ratio of 4.2:1 has been found to be satisfactory. This was accomplished by providing 23 teeth on ring gear 104, seven teeth on the first idler gear 114, nine teeth on the second idler gear 118 and seven teeth on the driven gear 132.

Figure 6:
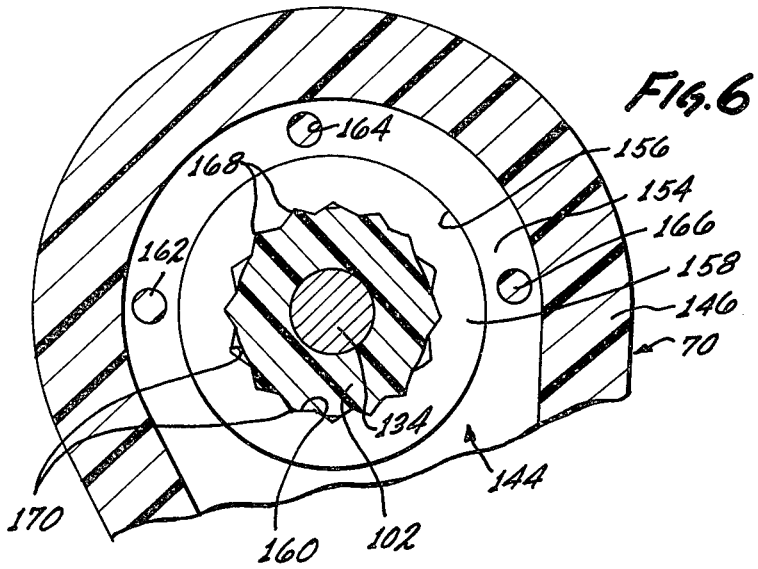
FIG. 6 is an enlarged, partial cross-sectional view taken along 6—6 of FIG. 5.

Referring now to FIGS. 5 and 6, legs 68, 70 each includes an armature assembly 144 embedded in a soft, pliable polymeric covering 146. Each armature assembly 144 is reinforced with ribs 150, 152 and includes an upper end 154 having an opening 156 surrounded by a hollow, frusto-conical boss 158 provided with an aperture 160 through which an associated one of the hubs 102, 136 extends. Each upper end 154 is provided with a plurality of apertures, as shown at 162, 164, 166 in FIG. 6 for leg 70, through which some of the material forming covering 146 flows during the molding operation which forms leg 70.

Figure 7:
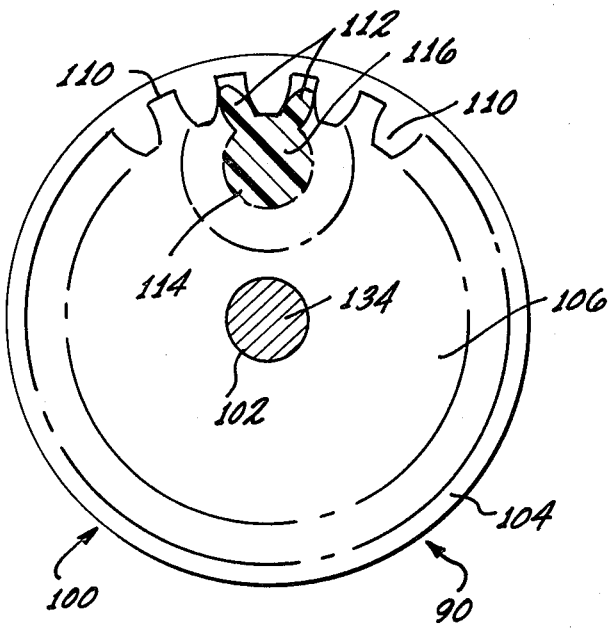
FIG. 7 is an enlarged, partial cross-sectional view taken along line 7—7 of FIG. 5.
Figure 8:
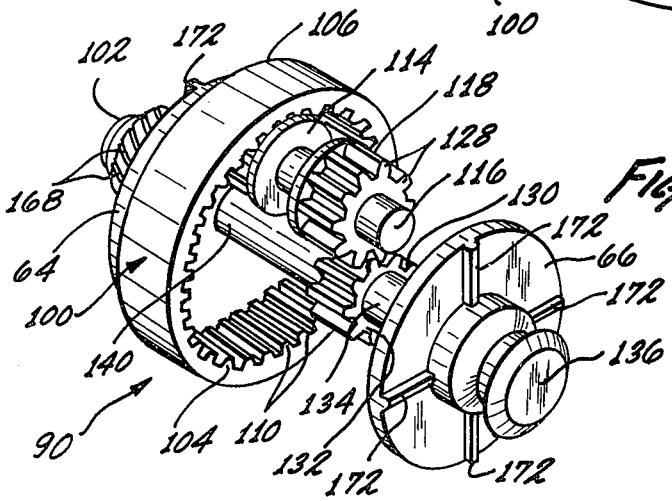
FIG. 8 is an enlarged perspective view of a gear train used in the doll shown in FIGS. 1–4.

As best seen in FIGS. 6 through 8, hub 102 is provided with serrations 168 engageable with matching teeth 170 provided on aperture 160 for forming a driving connection between leg 70 and driving gear 100. This connection, however, may be overridden by holding leg 68 while swinging leg 70 to any desired, rotated position. The hip mounting members 64, 66 are each provided with radially extending ribs 172 (FIGS. 5 and 8) frictionally engaging covering 146 for holding legs 68, 70 in rotated positions when it is desired to move legs 68, 70 to sitting positions, for example.

Operation of figure toy 10 will be described in connection with FIGS. 1–4. Figure toy 10 may removed from posing stand 18 and held by the hand 174 and forearm 176 of an operator (not shown) in the position shown in FIG. 2 with left leg 70 supported by surface 142. Assuming that the major axis of torso 26 will coincide with line 178 when figure toy 10 is in an upright position with legs 68, 70 parallel, the wrist 180 of the operator may be moved downwardly in the direction of arrow 182 while the back 184 of hand 174 is moved rearwardly in the direction of arrow 186 causing torso 26 to move rearwardly in the direction of arrow 188 until its major axis coincides with line 190. This causes driving gear 100 to drive leg 68 upwardly high and fast, compared to the amount torso 26 moves rearwardly, as will be apparent by comparing arrows 190, 192.

Figure 3:
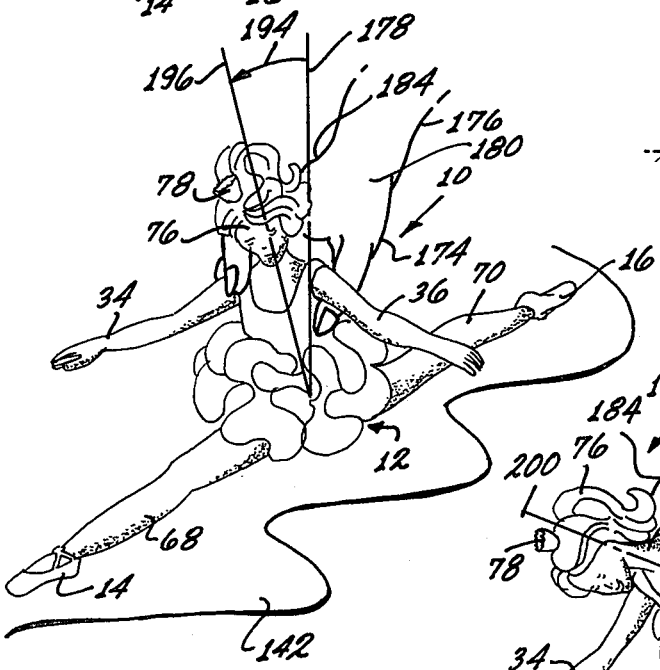

Figure toy 10 may then be caused to do the splits, as shown in FIG. 3, by pushing downwardly and forwardly on torso 26 until leg 70 is normal to torso 26 which may then be tipped forwardly in the direction of arrow 194 moving torso 26 from line 178 to line 196.

Figure 4:
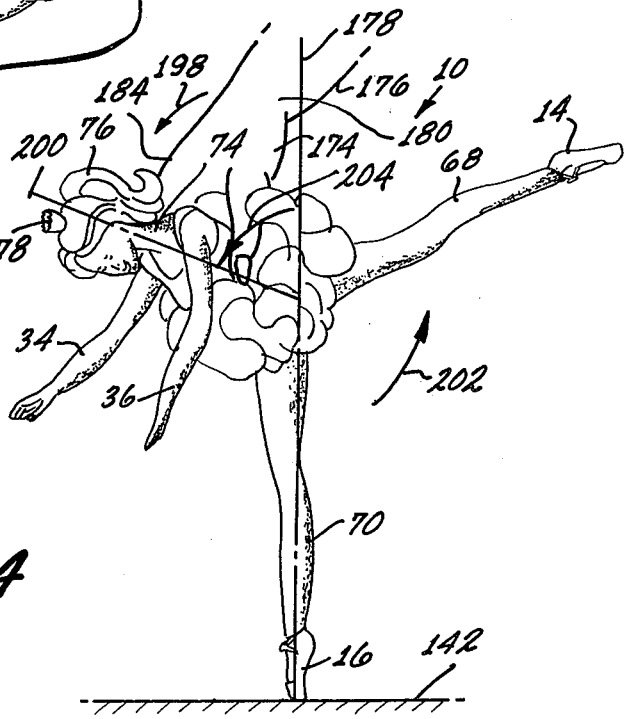

Referring now to FIG. 4, leg 68 may be caused to kick up rearwardly high and fast by positioning leg 70 on surface 142 and moving torso 26 forwardly in the direction of arrow 198 from line 178 to line 200. The leg 68 moves through a large arc, as indicated by arrow 202, compared to the relatively small arc through which torso 26 moves, as indicated by arrow 204.

While the particular figure toy herein shown and described in detail is fully capable of attaining the objects and providing the advantages hereinbefore stated, it is to be understood that it is merely illustrative of the presently preferred embodiment of the invention and that no limitations are intended to the details of construction and design herein shown and described in detail except as defined by the appended claims which form a part of this disclosure.

Whenever the term "means" is employed in these claims, it shall be understood to define the structure disclosed or the equivalent thereof.

What is claimed is:

1. In a figure toy having a pair of legs connected together by gears for transmitting swinging motions imparted to one leg to the other leg, the improvement which comprises:

first means increasing the gear ratio between said legs, whereby one leg will be swung through a substantially larger arc than the other leg and in a reverse direction from said other leg, said first means including a first gear having a first predetermined number of teeth, a second gear having a second predetermined number and teeth differing from said first predetermined number, an idler gear assembly connecting said first and second gears together, second means connecting said first gear to one of said legs and third means connecting said second gear to the other of said legs.

2. In a figure toy having at least a pair of limbs connected together by gears for transmitting swinging motions imparted to one limb to the other limb, the improvement which comprises:

means for negatively increasing the gear ratio between said limbs, whereby one limb will be swung through a substantially larger arc than the other limb and in a reverse direction from said other limb, said means for increasing said gear ratio comprising:

a ring gear affixed to one of said limbs, said ring gear including a first hub formed integrally therewith;

a shaft having a first end formed integrally with a second hub and a second, free end, said free end of said shaft being rotatably mounted in said first hub;

a spur gear affixed to said shaft intermediate said ends; and an idler gear assembly connecting said ring gear to said spur gear, said ring gear having at least twice as many teeth as said spur gear and said idler gear assembly.

3. An improvement as stated in claim 2 wherein said limbs are legs on said figure toy.

4. An improvement as stated in claim 2 wherein said gear ratio is 4.2:1.

5. An improvement as stated in claim 4 wherein said idler gear assembly includes a first idler gear engaging said ring gear, a second idler gear engaging said spur gear and a shaft connecting said first and second idler gears together, said ring gear having 23 teeth, said first idler gear having seven teeth, said second idler having nine teeth and said spur gear having seven teeth.

* * * * *